US006340046B1

(12) United States Patent
Basseches

(10) Patent No.: US 6,340,046 B1
(45) Date of Patent: Jan. 22, 2002

(54) COMPACT FOLDING SCREEN ASSEMBLY

(76) Inventor: Stuart Basseches, 97 Fifth Ave. 4A, New York, NY (US) 10003

( * ) Notice: Subject to any disclaimer, the term of this patent is extended or adjusted under 35 U.S.C. 154(b) by 0 days.

(21) Appl. No.: 09/766,992

(22) Filed: Jan. 23, 2001

(51) Int. Cl.[7] ..... A47G 5/00
(52) U.S. Cl. ..... 160/135; 211/195
(58) Field of Search ..... 160/135, 351, 160/352, 229.1, 130; 52/239; 40/605, 610; 211/195, 199

(56) References Cited

U.S. PATENT DOCUMENTS 2,917,188 A * 12/1959 Menin ..... 160/135
2,993,604 A * 7/1961 Sullivan ..... 160/135
4,001,987 A * 1/1977 Coulthard ..... 160/135 X
4,823,858 A * 4/1989 Perutz ..... 160/135
6,112,445 A * 9/2000 Feeney ..... 160/135 X

* cited by examiner

*Primary Examiner*—David M. Purol

(57) ABSTRACT

A compact folding screen assembly is comprised of a series of three or more hingedly interconnected panels. The panels are formed of a vertical array of beams which are generally H-shaped in vertical section, and include a central horizontal web, the ends of the web having vertical flanges. The flanges at one side of the beams of a first panel are coupled in spaced relation. The web of beams of a second adjacent panel extend through the space between the unconnected flanges of the first panel. Pivots extend between flanges of the second panel and webs of the first panel. The flanges of the beams of the second panel may pass through the webs of the beams of a third panel. When the panels are fully folded, the second panel is nested within the first and third panels providing a compact structure.

7 Claims, 5 Drawing Sheets

COMPACT FOLDING SCREEN ASSEMBLY

BACKGROUND AND FIELD OF THE INVENTION

The present invention relates to a foldable screen assembly of the type comprising a series of hingedly connected panels shiftable between an extended condition to provide a room divider and a collapsed side by side stored condition and an infinite variety of intermediate positions between extended and stacked.

PRIOR ART

Conventional screens, used as room dividers or the like, comprise a series of panels. Hinges span the margins of adjacent panels enabling the panels to be extended into coplanar or near coplanar alignment to divide a space. The screens can be folded into side by side stacked condition for storage. In the stacked condition, the thickness of the stack is the sum of the thickness of the individual panels

SUMMARY OF THE INVENTION

The present invention is directed to a screen assembly which is shiftable between an extended, space dividing condition and a stacked storing condition. The screen, in the storage condition, is of a thickness which is less than the sum of the thicknesses of the panels forming the screen. The screen provides a unique highly attractive appearance and has achieved substantial commercial success.

The screen is comprised of a plurality of panels. The panels are formed of vertically stacked interconnected beams, H-shaped in vertical section, including a central web, from the ends of which project vertically directed flanges extending above and below the plane of the web.

The flanges at one side of the beams of a first panel, i.e. the left-most flanges are coupled in spaced relation such that the said flanges are in coplanar alignment. The uncoupled flanges of the first panel (the right flanges) define spaces there between.

The beams of a second panel are coupled to the first panel by the left-most flanges of the second panel being pivotally connected to the webs of the first panel. The webs of the second panel are free to move through the spaced defined between the right hand flanges of the first panel.

The webs of the beams of adjacent panels are offset vertically. A third panel includes beams pivotally connected to the second panel, the left flanges of the third panel being pivotally connected to the webs of the beams of the second panel, the flanges of the second panel beams being spaced from, interposed between and shiftable through the webs of the third panel.

As a result of this structure, the first and third panels may be folded together with the second panel encompassed between the said first and third panels. The combined thickness of the three panels consists essentially of the thickness of the first and third panels only.

It will be appreciated that the screen structure will typically comprise seven or more panels as depicted in a drawing herein, the three panel figure provided herewith being included to simplify an understanding of the device.

DETAILED DESCRIPTION OF THE DRAWINGS

Figure 1:
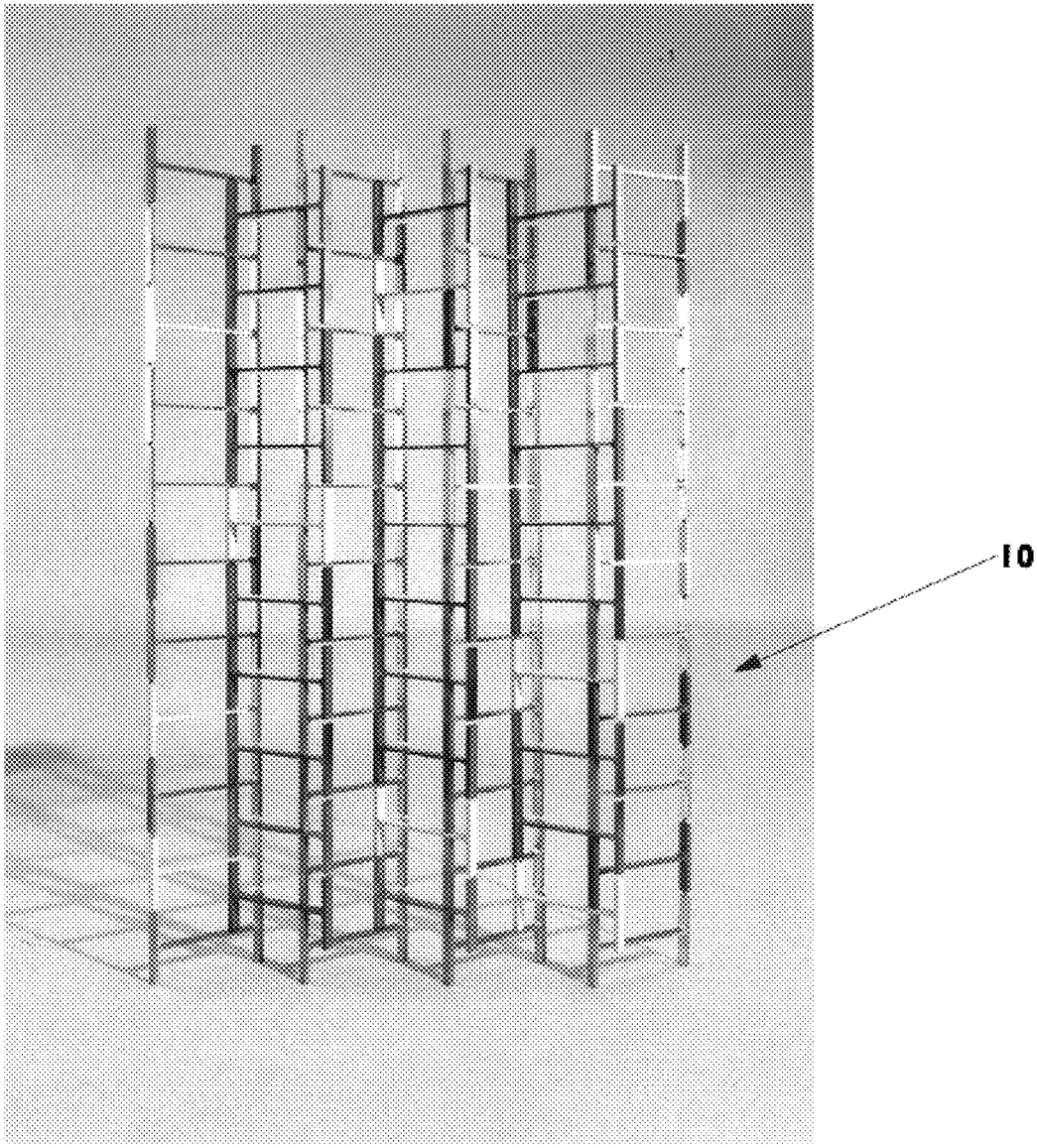
FIG. 1 is a perspective view of the screen in the partially extended condition in which it typically will be employed.
Figure 2:
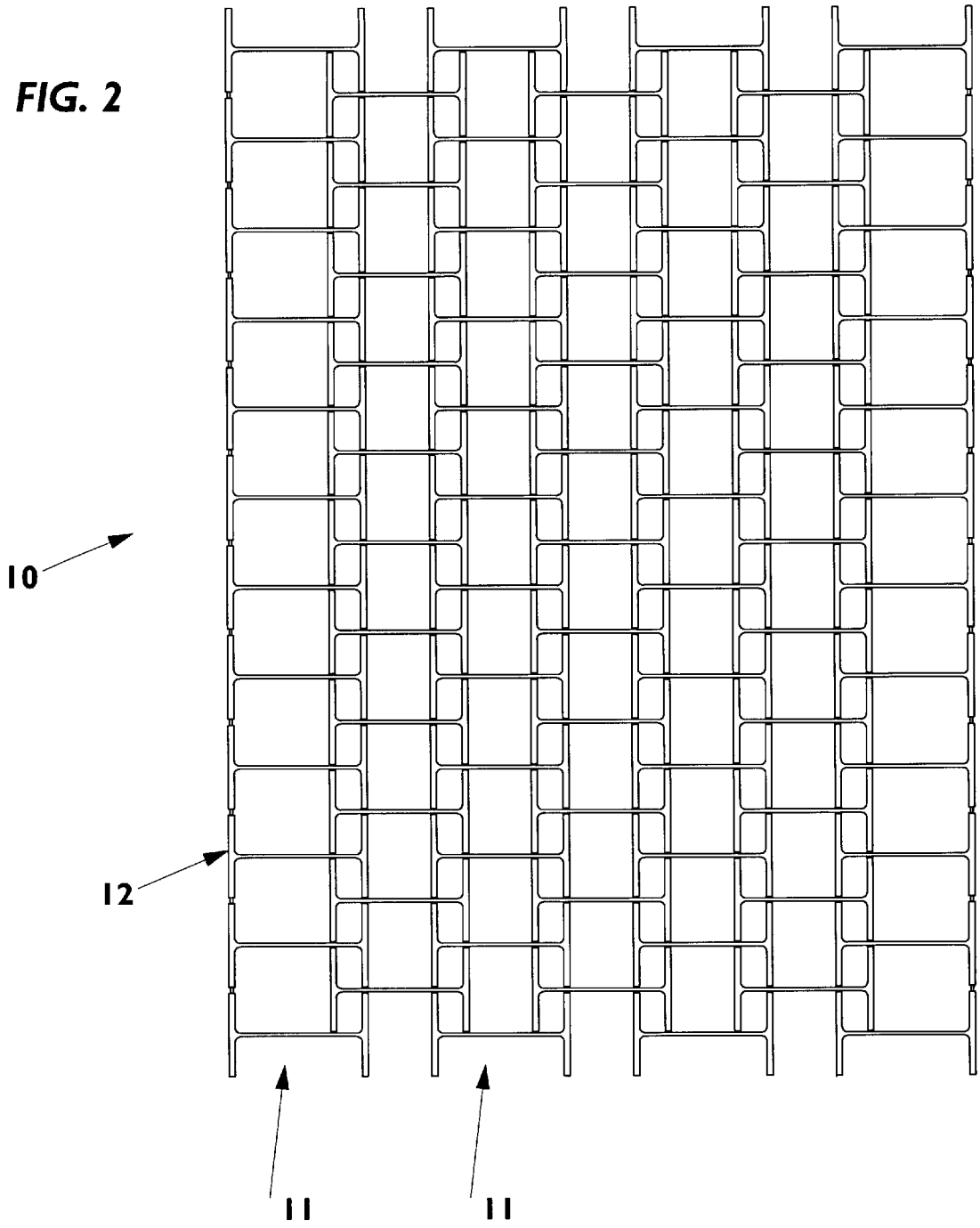
FIG. 2 is a front elevational view of the seven panel structure of FIG. 1 in the fully unfolded condition.

Referring now to the drawings there is shown in FIG. 1 a screen assembly 10 comprised of seven panels 11 each said panel being comprised of a plurality of beam components 12.

Figure 5:
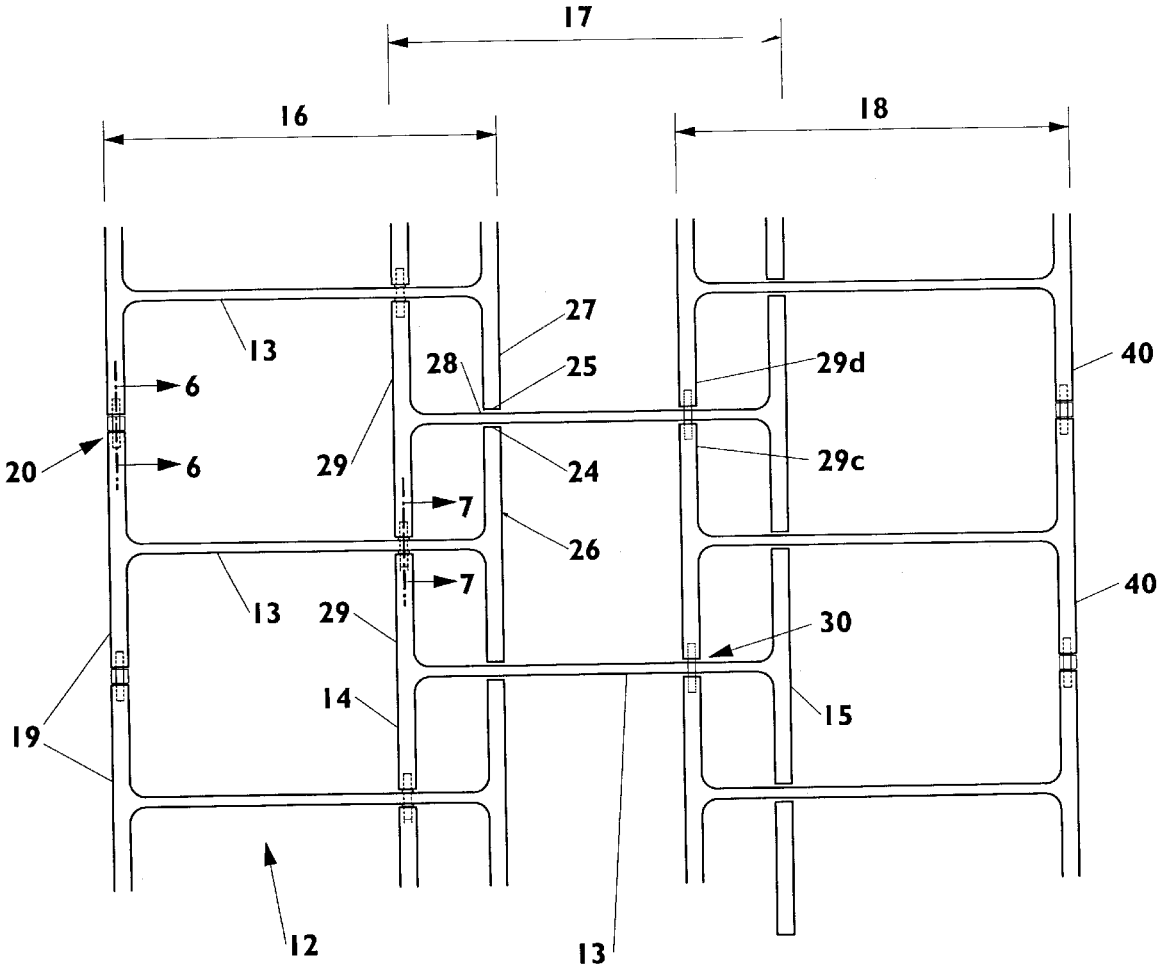
FIG. 5 is an enlarged front elevational view of a simplified structure comprised of three panels.

As best seen in FIG. 5, the beam components are H-shaped in transverse section including a central web 13, a left flange 14 and a right flange 15. The flanges 14, 15 are disposed perpendicular to the webs and extend equal distances above and below the webs.

Figure 6:
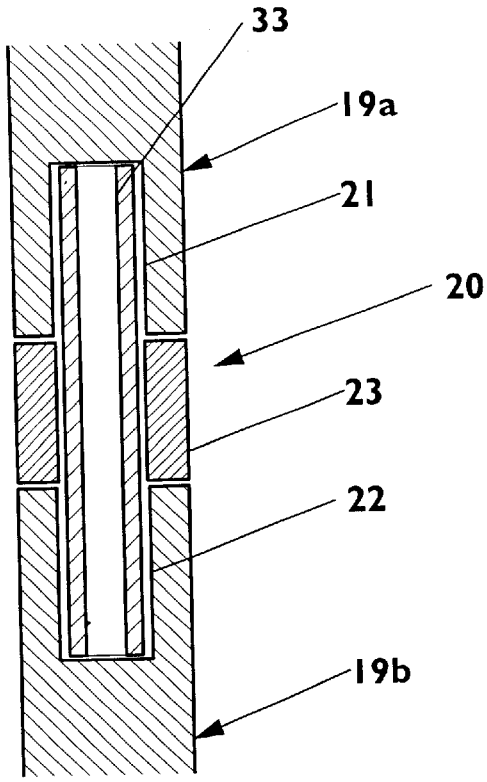
FIG. 6 is a magnified sectional view taken on line 6–6 of FIG. 5.

In the three panel structure of FIG. 5, panels 16 and 18 will be referred to as end panels, the end panels being pivotally connected to central panel 17. As is apparent, the left-most flanges 1 of the beams comprising panel 16 are non-rotatably connected by coupling assemblies 20 as depicted in FIG. 6. The connection is effected by roll pin 33 seated in opposed upper and lower aligned blind bores 21, 22, the length of the roll pin or spring pin being such as to maintain the lower end of upper flange 19*a* spaced from the upper end of lower flange 19*b*. Preferrably a spacer 23 is interposed between the flange ends.

As a result of the described connector linkage, the ends 24, 25 of the right hand flanges 26, 27 are spaced apart, defining a horizontal slot or opening 28 therebetween.

Figure 7:
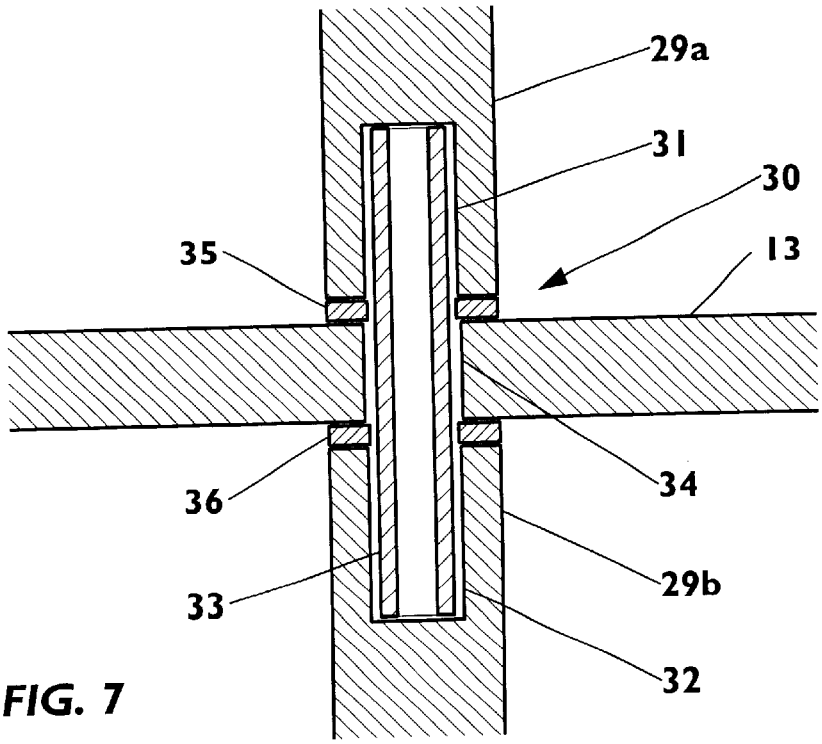
FIG. 7 is a magnified sectional view taken on line 7—7 of FIG. 5.

The left flanges 29 of the central panel 17 are interposed between the webs 13 of vertically adjacent beams of end panel 16. As best seen in FIG. 7, the upper and lower ends of the left flanges 29 are pivotally connected to spaced webs 13 as by connector assemblies 30. Connector 30 is comprised of a blind bore 31 in the lower end of upper flange 29*a*, an aligned blind bore 32 in the upper end of lower flange 29b and a roll or spring pin 33 having its upper and lower ends seated in the bases of bores 31, 32 respectively.

The roll pin 33 passes through aperture 34, teflon washers 35, 36 preferrably being disposed between the ends of flanges 29*a*, 29*b* and the web 13.

Connection between central panel 17 and end panel 18 is effected by pivotal couplings 30 (FIG. 7) linking web portions 13 of the beams of panel 17 to the left flanges 29*c*, 29*d* of the beams of panel 18. The beams of adjacent panels are vertically offset by a distance approximately of ½ the flanges.

The right hand flanges 40 of panel 18 are connected in coplanar alignment as by coupling assemblies 20.

As best appreciated from FIG. 5, the webs 13 of the beams of center panel 17 are free to swing through the spaces 28 defined between the right flanges of the panel 16. In similar manner, the right hand flanges 15 of the central panel 17 are free to pass between the webs 13 of the right hand most panel 18.

Figure 3A:
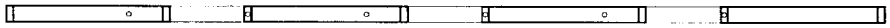
FIGS. 3*a*, 3*b*, and 3*c* are top plan views of a seven panel structure in accordance with the invention, respectively in the fully unfolded, partially folded and fully folded conditions thereof.
Figure 3B:
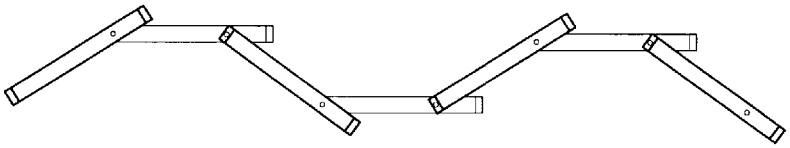

It will be appreciated that screen assemblies will normally be comprised of more than three panels, i.e. a seven panel unit being depicted in FIG. 1. In FIG. 3*a* a seven panel unit is depicted in which the panels are aligned to define a planar structure. In FIG. 3*b* the panels arc shown in partially folded condition and in 3*c* fully folded.

Figure 3C:
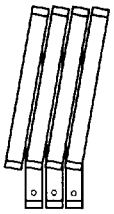
Figure 4:
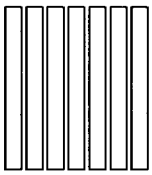
FIG. 4 Prior Art
FIG. 4 is a top plan view of a prior art seven panel screen, in the fully folded condition.

FIG. 4 depicts the folded condition of prior art screens which are hingedly connected at their ends. In contrast, it will be perceived from a comparison of FIGS. 3*c* and 4 that the screen of the instant device provides a more compact folded arrangement as a result of central panels, such as panel 17, nesting within adjacent panels such as 16 and 18. The nesting ability is the result portions of "central" panels passing through elements of "end" panels.

The screen of the present invention provides a uniquely attractive appearance and in addition a practical assembly which may be readily stored in a compact condition.

As will be apparent to those skilled in the art and familiarized with the instant disclosure, numerous details of structure may be made without departing from the spirit of the invention. Accordingly, the invention is to be broadly construed within the scope of the appended claims.

I claim:

1. A compact folding screen assembly comprising a first panel and a second panel hingedly connected to said first panel, each said panel comprising a plurality of interconnected generally H-shaped beam members, said beam members comprising a horizontally disposed central web having a left flange and a right flange extending perpendicularly from the left and right ends respectively of said web, connection means interposed between the said left flanges of said beams of said first panel for connecting said left flanges in spaced coplanar alignment and defining spaces between said right flanges, said second panel comprising a plurality of said beam members, the webs of said beam members of said second panel being shiftable through respective said spaces, and pivot means interposed between said left flanges of said beams of said second panel and opposed portions of said webs of said beams of said first panel.

2. A screen assembly in accordance with claim 1 and including a third panel hingedly connected to said second panel, said third panel comprising a plurality of said beams, left hand flanges of said beams of said third panel being interposed between and pivotally connected to opposed portions of the webs of said beams of said second panel.

3. A screen assembly in accordance with claim 2 wherein the webs of the beams of adjacent panels are vertically offset one from another by a distance of about one half of the length of said flanges.

4. A compact folding screen structure comprising a center panel and two side panels pivotally connected at opposite sides of said center panel, said panels comprising a plurality of stacked coplanar aligned beams H-shaped in vertical section, said beams including a central web, a right flange and a left flange, said flanges extending perpendicularly from the right and left ends respectively of said web, connectors interposed between opposed portions of said left flanges of said side panels, said connectors coupling said left flanges in spaced coplanar alignment and supporting said right flanges of said beams of said side panels in spaced relation to define openings between opposed said right flanges, said webs of said central panel extending through said openings of said one side panel, and pivot means interposed between the left flanges of the beams of said center panel and opposed portions of said webs of said one side panel.

5. A compact folding screen structure comprising first, second, and third panels each formed of beams H-shaped in transverse section, said beams comprising a horizontally disposed central web, a right flange and a left flange, said flanges extending perpendicularly from the right and left ends respectively of said web, connectors interposed between opposed portions of said left flanges of said first panel, said connectors coupling said left flanges in spaced coplanar alignment and supporting said right flanges of said beams of said first panel in spaced relation to define an opening therebetween, the left flanges of said second panel being pivotally connected to the web portions of adjacent beams of said first panel, the left flanges of the beams of said third panel being pivotally connected to the webs of adjacent beams of said second panel.

6. A folding screen in accordance with claim 5 wherein the right flanges of the beams of said second panel are shiftable through the spaces between adjacent webs of said third panel, and the webs of the beams of said second panel are shiftable through said openings between the right flanges of said first panel.

7. A compact folding screen structure comprising a plurality of panels, including a center panel and side panels pivotally connected to opposite sides of said center panel, each said panel comprised of a plurality of beams H shaped in vertical section, said beams comprising a central web having a left flange and a right flange extending from the left and right sides respectively of said web, the beams of adjacent said panels being interconnected such that a web of said center panel can be shifted through spaces between opposed flanges of the beams of one said side panel and the flanges of said center panel can be shifted through spaces between webs of beams of the other said side panel.

* * * * *